United States Patent [19]

Graves

[11] Patent Number: 4,561,696

[45] Date of Patent: Dec. 31, 1985

[54] IN SITU RECOVERY OF MINERAL VALUES

[75] Inventor: Charles W. Graves, Lake Elmo, Minn.

[73] Assignee: Phillips Petroleum Company, Bartlesville, Okla.

[21] Appl. No.: 420,975

[22] Filed: Sep. 21, 1982

[51] Int. Cl.[4] ..... E21B 43/28

[52] U.S. Cl. ..... 299/4; 166/271

[58] Field of Search ..... 166/245, 271; 299/4, 299/5

[56] References Cited

U.S. PATENT DOCUMENTS

| | | | |
|---|---|---|---|
| 2,850,270 | 9/1958 | Henson | 299/5 |
| 3,064,957 | 10/1962 | Jacoby | 299/5 |
| 3,086,760 | 4/1963 | Bays | 299/5 |
| 4,084,637 | 4/1978 | Todd | 166/245 |
| 4,105,252 | 8/1978 | Moore | 299/4 |

*Primary Examiner*—Stephen J. Novosad
*Assistant Examiner*—Mark J. DelSignore
*Attorney, Agent, or Firm*—C. F. Steininger

[57] ABSTRACT

Mineral values, particularly uranium, are recovered "in situ" from a subsurface earth formation by completing at least one well in the mineralized formation adjacent either the top or the bottom of the mineralized formation, completing at least one second well in the mineralized formation adjacent the opposite of the top and the bottom of the mineralized formation, forming a horizontally-oriented fracture in the mineralized formation adjacent at least one of the top and the bottom of the mineralized formation, each of which fractures is in open communication with that well which has been completed at a corresponding vertical level, injecting a leach solution, adapted to solvate the mineral values, into the first or the second well, which thus becomes an injection well, and thence into that fracture which is in communication with the injection well and producing the leach solution, containing solvated mineral values, from the other of the first and second wells, which thus becomes the production well, whereby the leach solution flows from the injection well generally horizontally through the fracture in communication with the injection well, thence generally vertically through the mineralized formation and thence generally horizontally to the production well.

10 Claims, 1 Drawing Figure

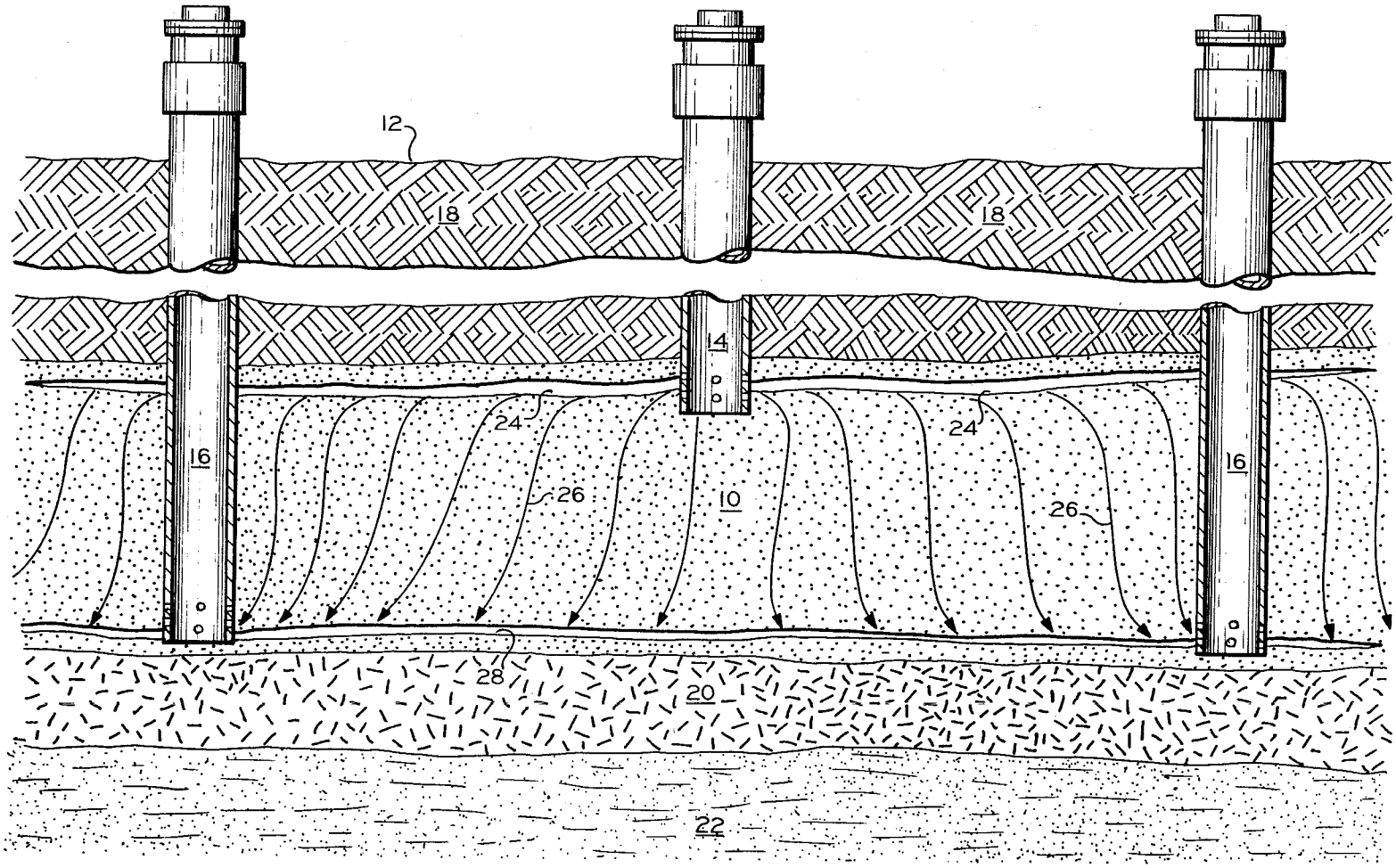
12
18
18
14
16
16
10
24
24
26
26
28
20
22

IN SITU RECOVERY OF MINERAL VALUES

BACKGROUND OF THE INVENTION

The present invention relates to the extraction of mineral values from mineral-containing materials. In a more specific aspect, the present invention relates to the extraction of mineral values in situ from subsurface formations. In a still more specific aspect, the present invention relates to the extraction of uranium values in situ from subsurface formations containing uranium.

Numerous minerals are present in subsurface earth formations in very small quantities which make their recovery extremely difficult. However, in most instances, these minerals are also extremely valuable, thereby justifying efforts to recover the same. An example of one such mineral is uranium. However, numerous other valuable minerals, such as copper, nickel, molybdenum, rhenium, silver, selenium, vanadium, thorium, gold, rare earth metals, etc., are also present in small quantities in subsurface formations, alone and quite often associated with uranium. Consequently, the recovery of such minerals is fraught with essentially the same problems as the recovery of uranium and, in general, the same techniques for recovering uranium can also be utilized to recover such other mineral values, whether associated with uranium or occurring alone. Therefore, a discussion of the recovery of uranium will be appropriate for all such minerals.

Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vanadium, gold and the like, can be simultaneously recovered.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a "pregnant" solution, is produced through at least one production well penetrating the deposit. The present invention is directed to the latter, "in situ" leaching.

The most common aqueous leach solutions are either aqueous acidic solutions, such as sulfuric acid solutions, or aqueous alkaline solutions, such as sodium carbonate and/or bicarbonate.

Aqueous acidic solutions are normally quite effective in the extraction of uranium values. However, aqueous acidic solutions generally cannot be utilized to extract uranium values from ore or in situ from deposits containing high concentrations of acid-consuming gangue, such as limestone. Aqueous alkaline leach solutions are applicable to all types of uranium-containing materials and are less expensive than acids.

The uranium values are conventionally recovered from acidic leach solutions by techniques will known in the mining art, such as direct precipitation, selective ion exchange, liquid extraction, etc. Similarly, pregnant alkaline leach solutions may be treated to recover the uranium values by contact with ion exchange resins, precipitation, as by adding sodium hydroxide to increase the pH of the solution to about 12, etc.

As described to this point, the extraction of uranium values is dependent to some extent upon the economics of mining versus in situ extraction and the relative costs of acidic leach solutions versus alkaline leach solutions. However, this is an oversimplification, to the extent that only uranium in its hexavalent state can be extracted in either acidic or alkaline leach solutions. While some uranium in its hexavalent state is present in ores and subterranean deposits, the vast majority of the uranium is present in its valence states lower than the hexavalent state. For example, uranium minerals are generally present in the form of uraninite, a natural oxide of uranium in a variety of forms such as $UO_2$, $UO_3$, $UO.U_2O_3$ and mixed $U_3O_8$ ($UO_2.2UO_3$), the most prevalent variety of which is pitch blende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from subsurface deposits with aqueous acidic or aqueous alkaline leach solutions, it is necessary to oxidize the lower valence states of uranium to the soluble, hexavalent state.

Combinations of acids and oxidants which have been suggested by the prior art include nitric acid, hydrochloric acid or sulfuric acid, particularly sulfuric acid, in combination with air, oxygen, sodium chlorate, potassium permanganate, hydrogen peroxide and magnesium dioxide, as oxidants. Alkaline leachants and oxidants heretofore suggested include carbonates and/or bicarbonates of ammonium, sodium or potassium in combination with air, oxygen or hydrogen peroxide, as lixiviants. However, sodium bicarbonate and/or carbonate have been used almost exclusively in actual practice.

While the previous discussion would indicate that "in situ" recovery of mineral values, such as uranium, is fairly simple and straight forward and would appear to be the best technique in most cases, except for the volumes of leach solution required, the very nature of subsurface formations containing mineral values and the types of formations in which such mineral values are found seriously complicate "in situ" recovery.

The general practice is, of course, to complete both the injection wells and the production wells through the entire vertical dimension of the formation of interest. Accordingly, the body of leach solution travels in a radial pattern and in a horizontal direction from the injection well or wells to the producing well or wells. It is known from experience, in the leaching of mineral values as well as the injection of drive fluids in secondary and tertiary recovery of oil, that the area of the reservoir actually contacted by the injection fluids is relatively small, simply because the injected fluids do not flow in a uniform radial pattern and it is wholly impractical to drill a sufficient number of injection and production wells to take full advantage of the natural flow patterns. This lack of adequate "aereal" sweep or contact of the formation is further seriously complicated by the fact that the porosity of a formation is seldom uniform and the injected fluids will have a tendency to follow fissures, high permeability streaks, etc. in traveling from the injection wells to the producing wells. Therefore, improvement of the aereal sweep of the formation is highly desirable.

In addition to the above, the mineralized formation may sometimes be bounded by porous formations above or below the formation of interest and in many cases, such zones are of higher porosity than the zone of interest and are of greater vertical dimensions. Accordingly, substantial volumes of the injected fluid are lost in these thief zones. Therefore, it is also highly desirable to reduce this loss of injected fluids.

At the present time, all commercial operations for the recovery of mineral values, particularly uranium, are believed to be confined to "wet" formations which are located below the water table and which have a natural water drive which augments the flow of injected fluids through the formation. However, there are a number of uranium containing deposits in "dry" formations which lack a natural water drive, usually those located above the water table. In many cases, even though these formations are relatively shallow, they cannot be practically or economically recovered by conventional mining means and "in situ" recovery is the only alternative. However, there are presently no known techniques available for the recovery of uranium from these formations which lack a natural water drive.

SUMMARY OF THE INVENTION

It is, therefore, an object of the present invention to provide an improved method for recovering mineral values from materials containing the same which overcomes the above-mentioned and other problems of the prior art. A further object of the present invention is to provide an improved method for recovering mineral values from subsurface earth formations containing the same by "in situ" extraction. Another and further object of the present invention is to provide an improved method for the recovery of mineral values from subsurface earth formations containing the same wherein a leach solution adapted to solvate such mineral values is injected into subsurface formation and the leach solution containing significant amounts of mineral values is then withdrawn. A still further object of the present invention is to provide an improved method for the "in situ" leaching of mineral values from subsurface formations which significantly reduces the volume of leach solution required. Yet another object of the present invention is to provide an improved method of "in situ" leaching of mineral values from subsurface formations in which the aereal sweep of the formation is significantly improved. Another and further object of the present invention is to provide an improved method for the "in situ" leaching of mineral values from a subsurface formation which is applicable to formations which lack a natural water drive. Still another object of the present invention is to provide an improved method for recovering mineral values, particularly uranium, from subsurface formations in accordance with the above and other objects. These and other objects of the present invention will be apparent from the following description.

In accordance with the present invention, mineral values are recovered from subsurface earth formations containing the same by completing at least one well in the mineralized formation adjacent either the top or bottom of the formation or both, completing at least one other well in the formation adjacent the other of the top or the bottom of the formation, forming at least one horizontally oriented fracture in the formation in open communication with at least one of the thus completed wells adjacent the top or the bottom of the formation, as the case may be, injecting a leach solution adapted to solvate the mineral values into one of the wells, which thus becomes an injection well, and thence into that fracture which is in communication with the injection well and producing the leach solution containing solvated mineral values from the other of the wells, which thus becomes a production well, whereby the leach solution flows from the injection well, generally horizontally, through a fracture in communication with the injection well, thence generally vertically through the formation and thence generally horizontally to the production well. In another embodiment, a horizontally oriented fracture is formed adjacent both the top and bottom of the mineralized formation and the leach solution is injected into one of the wells, travels generally horizontally through one of the fractures, thence generally vertically to the other of the fractures, and thence generally horizontally to the production well.

BRIEF DESCRIPTION OF THE DRAWING

The single FIGURE of drawings is a schematic view, partially in cross-section, illustrating the practice of the present invention.

PREFERRED EMBODIMENTS OF THE INVENTION

As previously pointed out in the introductory portion hereof, the present invention is directed to the "in situ" recovery of mineral values from subsurface earth formations, particularly such formations which lack a natural water drive. The method of the present invention generally includes completion of at least one well adjacent the top or the bottom of the mineralized formation, completing another well adjacent the other of the top and the bottom of the formation, forming a horizontally oriented fracture adjacent the top or the bottom of the formation or both, and in communication with the thus completed well or wells, as the case may be, injecting a leach solution into one of the wells adjacent the top or the bottom of the formation and producing leach solution containing extracted mineral values from the other of the wells completed adjacent the other of the top or the bottom of the formation.

As is also previously pointed out, mineral formations lacking in natural water drive are generally above the water table and thus relatively shallow. In addition, horizontally oriented fractures are most effectively created at shallow depths where the pressure of the fracturing fluid is capable of lifting the overburden.

Finally, "in situ" recovery techniques, such as that of the present invention, will generally be most economical where the formation is located at depths at which conventional mining is impractical or too expensive.

In view of the above, the method of the present invention will, in most cases, be applicable to subsurface formations located between about 500 and 1000 feet below the surface of the earth. However, it should be recognized that there are exceptions to the above and the method of the present invention can be practiced to recover mineral values from formations from above and below the specified depths.

The nature and advantages of the present invention will best be understood by reference to the single FIGURE of drawings and the following description.

In accordance with the FIGURE of the drawings, the numeral 10 represents a porous formation containing mineral values, which it is desired to recover and which is located below the surface of the earth 12. At least one well, 14, is completed, i.e., drilled, cased, cemented, perforated, etc. adjacent the top of the mineralized formation 10. At least one other well, 16, is completed adjacent the bottom of the mineralized formation 10. At least one of the wells 14 or 16 is utilized for the injection of the leach solution, and thus becomes an injection well, while the other of the wells is used to produce the pregnant leach solution, and thus becomes a production well. While the well 14 in the illustrated embodiment is considered the injection well and the wells 16 as the production wells, for purposes of the present description, it is to be recognized that the injection well may be completed adjacent either the top or the bottom of the mineralized formation 10 and the production well or wells may be completed in the opposite of the top or the bottom of the mineralized formation 10. The aereal pattern of injection and production wells may be varied considerably, depending to some extent upon the aereal extent of the mineralized formation 10 and/or its aerial configuration. However, there are certain aereal patterns of injection and production wells which are known to be best adapted for the injection and production of fluids. Such patterns are well known in the art of secondary and tertiary oil recovery by fluid injection. For example, a "5-spot" pattern has been found quite effective, both in oil recovery and the recovery of mineral values by fluid injection. In this pattern, an injection well is located in the center of a square area and production wells are located at each of the four corners of the square. The pattern is then extended by drilling two additional production wells adjacent the first "5-spot" to form an additional square and drilling an additional injection well in the center of the second square, etc. Other patterns of injection and production wells are well known to those skilled in the art of petroleum recovery, as well as the recovery of mineral values by fluid injection.

In the situation illustrated, the numeral, 18, designates the overburden formation or formations above the mineralized formation 10 and the numeral, 20, designates a formation or formations below the mineralized formation 10. The formations immediately adjacent the mineralized formation 10 may be either impermeable or permeable and the technique of the present invention will still be effective in recovering mineral values from mineralized formation 10. The numeral 22 designates the water table in the example being described.

A "pancake" or horizontally oriented fracture 24 is formed in the mineralized formation 10 adjacent the top of the formation and in open communication well 14 at the zone where the well is completed. Subsurface formation fracturing is well known to those skilled in the art of oil production. While such artificial formation fractures will generally be vertically-oriented, particularly in deep formations, techniques are also well known for creating horizontally-oriented fractures, for example, see U.S. Pat. Nos. 3,455,391 and 4,105,252. Briefly, such fracturing is accomplished by pumping fluid down the well to the point at which fracturing is to be accomplished under a sufficiently high pressure to fracture the formation. In many cases, ordinary liquids, particularly crude oils, can be utilized to create the fractures. However, to the extent that the fracturing fluid flows into the porous formation at a rate such that sufficient fracturing pressure cannot be built up, viscified fracturing fluids can be utilized. Since in most cases, the fracturing will tend to close once the pressure of the fracturing fluid is released, the fracturing fluid is generally followed by a carrier fluid containing a propping material, such as sand, walnut shells, glass beads, etc. The carrier fluid deposits the propping agent in the fracture and when the pressure is released, the original width of the fracture is essentially maintained by the propping agent. Such mechanical propping is required to keep horizontal fractures open, since the weight of the overburden will generally close the fracture and the desired high permeability fracture will not be obtained. The carrier fluid may be followed by a flush fluid to clean out loose debris and proppant and establish the permeability of the propped fracture. The injected fluids are then either introduced through the well in which the fracturing was carried out or the well is used as a production well. In any event, the propped fracture will have a permeability substantially greater than the permeability of the formation fractured and thus provide a flow channel through which fluid will flow much more readily than the unfractured portions of the formation.

As illustrated in the drawing, well 14 is completed and fractured as an injection well. Consequently, the leach solution is injected through well 14 and preferentially flows in a generally horizontal direction through fracture 24. The leach solution will then flow downwardly in a generally vertical direction, as indicated by the flow lines 26, to the bottom of mineralized formation 10 and thence generally horizontally into production wells 16, which are in communication with the bottom of mineralized formation 10, as a result of having been completed in a zone adjacent the bottom of the formation. The pregnant leach solution is then produced through production wells 16. To the extent that the flow through mineralized formation 10 is too rapid to permit sufficient contact between the leach solution and the mineral values and thus provide insufficient time for the leach solution to solvate the maximum amount of mineral values, production wells 16 may be shut in to permit a soaking period or extended contact time between the leach solution and the mineral values and thereafter produced to remove the pregnant leach solution.

As previously pointed out, the pregnant leach solution may then be treated in any of a variety of known ways to recover the mineral values therefrom. The leach solution may then be reused, if desired, with or without the addition of alkali or acid and oxidants.

It is to be recognized that the method of the present invention is applicable to and advantageous in the recovery of mineral values from the mineralized formation 10 whether the formations 18 and 20 above and below mineralized formation 10, respectively, are essentially impermeable or are permeable. In the former case, it will generally not be necessary to create a horizontally oriented fracture adjacent the bottom of mineralized formation 10 in order to accomplish the results of and attain the advantages of the present invention. However, even in such cases, a fracture adjacent the bottom of mineralized formation 10 is helpful. In any event, if the formation 20, for example, is permeable and thus will act as a thief zone for leach solution, a second horizontally oriented fracture 28 should be formed adjacent the bottom of mineralized formation 10, so as to act as a high permeability channel for production of the pregnant leach solution. Since, as previously pointed out, the fracture will have a substantially higher permeability than the porous mineralized formation 10. It will also have a permeability higher than any adjacent porous formation. Consequently, the pregnant leach solution will preferentially flow through the fracture 28, rather than into the permeable formation 20 below mineralized formation 10. Thus, substantial volumes of leach solution will be saved by the present technique, since little of the leach solution will pass into the formation below the mineralized formation 10. The same applies to the fracture adjacent the top of mineralized formation 10 and formation 18 above the mineralized formation 10. If formation 18 is permeable, injected leach solution will preferentially flow through fracture 24, rather than substantially large volumes thereof flowing into permeable formation 18.

As previously pointed out, injection well 14 may be completed adjacent the bottom of mineralized formation 10 and production wells 16 may be completed adjacent the top of mineralized formation 10. Accordingly, the flow of fluids will be in the opposite direction to that shown in the drawing.

As previously pointed out in the introductory portion hereof, in conventional fluid injection, relatively poor aereal coverage of the formation is obtained. However, when practicing the present invention, the injected leach solution preferentially flows through the fracture in communication with the injection well before appreciable amounts thereof flow into and through the mineralized formation 10. Consequently, substantially improved aereal sweep of the mineralized formation 10 will be obtained, since the area covered and thus the volume of the mineralized formation 10 contacted by the leach solution will be essentially the volume below the fracture 24.

While specific materials and techniques have been described herein, it is to be understood that such specific references are for illustrative purposes and to set forth the best mode of practicing the present invention and are not to be considered limiting.

That which is claimed:

1. A method for the in situ recovery of mineral values from a permeable earth formation containing said mineral values, comprising:

(a) completing at least one first well in the mineralized formation at a first vertical level adjacent one of the top and the bottom of said mineralized formation;

(b) completing at least one second well in said mineralized formation at a second vertical level adjacent the other of said top and said bottom of said mineralized formation;

(c) forming a horizontally-oriented fracture in said mineralized formation at at least one of said vertical levels and extending across substantially the entire horizontal area of said formation between said first and second wells;

(d) each said fracture being in fluid communication with the one of said first and second wells which has been completed at the one of said vertical levels at which the fracture is located but not in fluid communication with the other of said first and second wells which has been completed at the other of said vertical levels;

(e) injecting a leach solution, adapted to solvate said mineral values, into one of said first and second wells which is in fluid communication with a thus formed fracture, which thus becomes an injection well, under conditions and in a manner to initially flow horizontally through the fracture in communication with said injection well and essentially fill said fracture, thereafter flow vertically to the opposite one of said vertical levels and thence flow horizontally to the other of said first and second wells which has been completed at said opposite one of said vertical levels; and (f) producing said leach solution, containing a significant amount of solvated mineral values, from the other of said first and second wells, which thus becomes a production well.

2. A method in accordance with claim 1 wherein the mineralized formation lacks a natural water drive.

3. A method in accordance with claim 1 wherein the mineralized formation is bounded by a permeable formation essentially devoid of mineral values at at least one of the top and the bottom of the mineralized formation and at least one of the fractures is formed in said mineralized formation at a vertical level corresponding to that at which said mineralized formation is in contact with said permeable formation.

4. A method in accordance with claim 1 wherein the wells are oriented in at least one "5-spot" pattern with the injection well near the center of a square area and a production well is located at each of the corners of said square area.

5. A method in accordance with claim 1 wherein a fracture is formed adjacent the top of the mineralized formation.

6. A method in accordance with claim 1 wherein a fracture is formed adjacent the bottom of the mineralized formation.

7. A method in accordance with claim 1 wherein a fracture is formed adjacent both the top and the bottom of the mineralized formation.

8. A method in accordance with claim 1 wherein the leach solution is an acidic leach solution.

9. A method in accordance with claim 1 wherein the leach solution is an alkaline leach solution.

10. A method in accordance with claim 1, 2, 3, 4, 5, 6, 7, 8, or 9 wherein the mineral values include uranium.

* * * * *